United States Patent [19]

Johnson

[11] 4,024,774

[45] May 24, 1977

[54] MODULAR CAM DRIVEN ROLL FEED

[75] Inventor: Kenneth C. Johnson, Des Plaines, Ill.

[73] Assignee: F. J. Littell Machine Company, Chicago, Ill.

[22] Filed: Feb. 5, 1976

[21] Appl. No.: 655,440

[52] U.S. Cl. ..... 74/606 R; 74/395; 308/31

[51] Int. Cl.[2] ..... F16H 57/02

[58] Field of Search ..... 74/606

[56] References Cited

UNITED STATES PATENTS

| | | | |
|---|---|---|---|
| 3,783,710 | 1/1974 | Steinhagen | 74/606 R X |
| 3,949,626 | 4/1976 | Berlinger, Jr. et al. | 74/606 R X |

*Primary Examiner*—Leonard H. Gerin

*Attorney, Agent, or Firm*—Russell H. Clark

[57] ABSTRACT

In the strip feeding mechanism of the invention, the main drive shaft drives meshing bevel gears on secondary shafts respectively, which extend in opposite directions with one secondary shaft being journalled by a main bearing cartridge unit. The said cartridge unit is characterized by a concentric surface and by an eccentric surface which is adjacent to the annular flanges of the unit. This novel feature of the cartridge unit enables the secondary shaft journalled thereby to be secured in the housing wall so as to eliminate all clearances in the bevel gearing and also to eliminate all clearances in the conjugate cam arrangements which are driven by this secondary shaft.

8 Claims, 8 Drawing Figures

Figure 3:
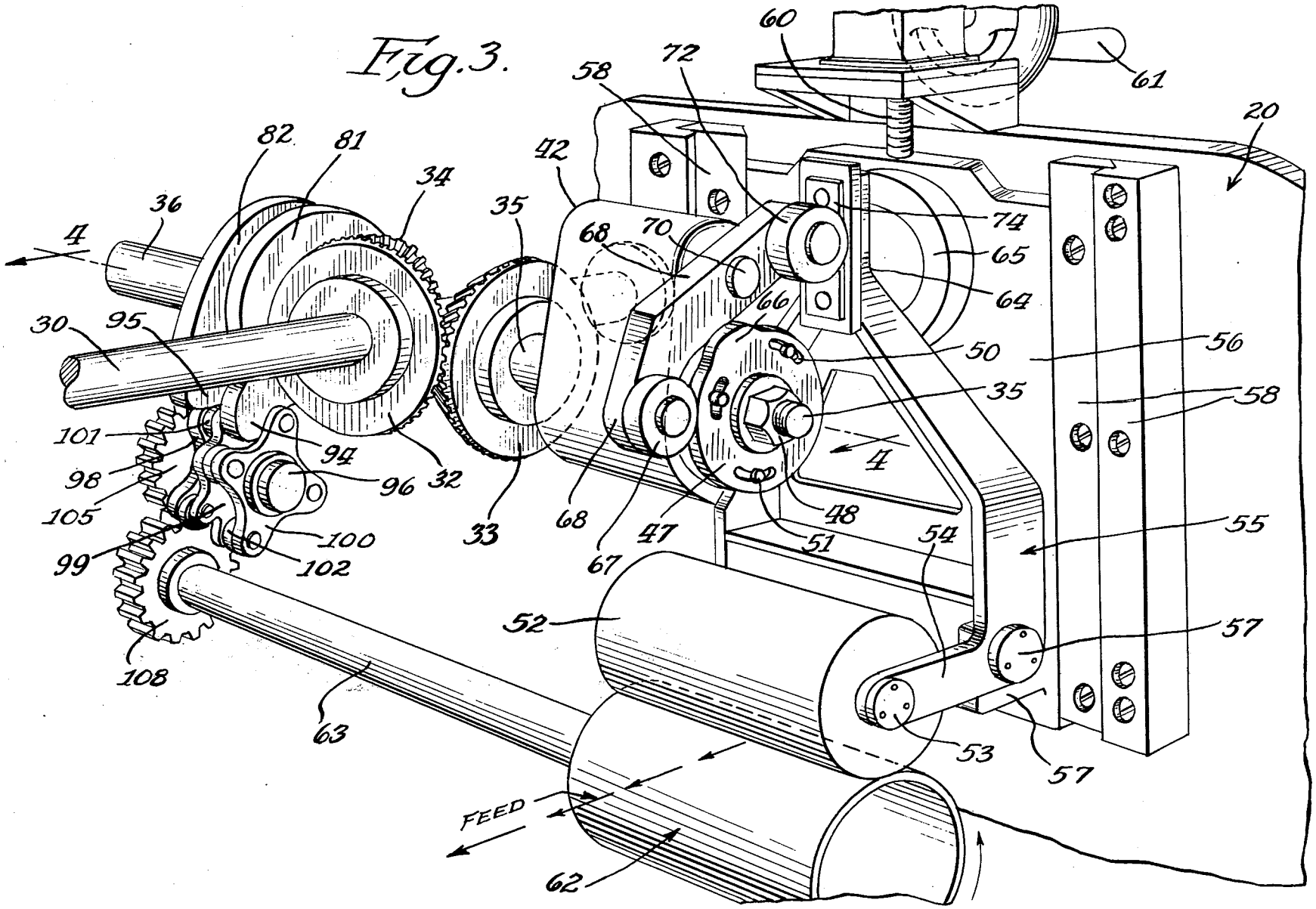

Fig. 1.
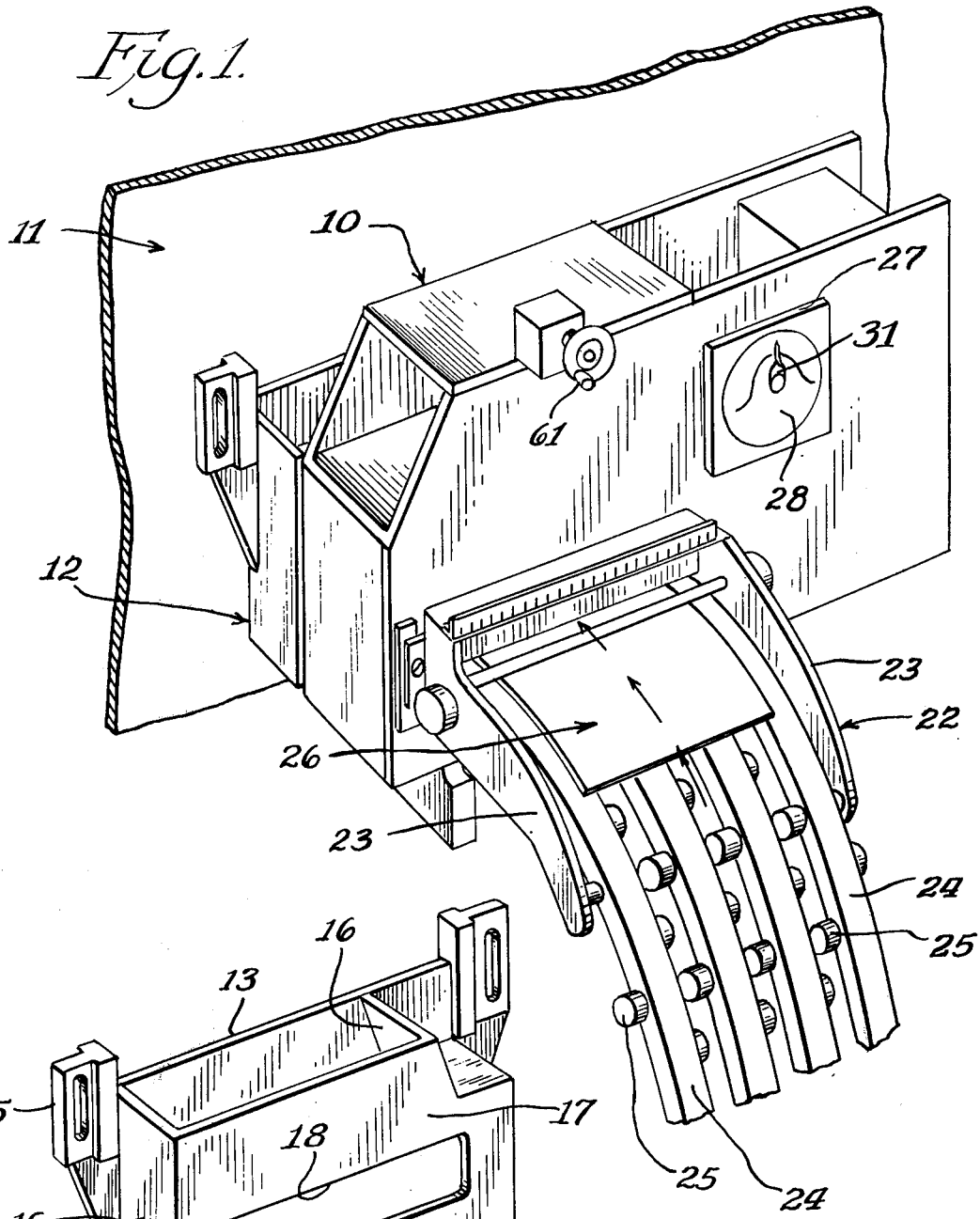
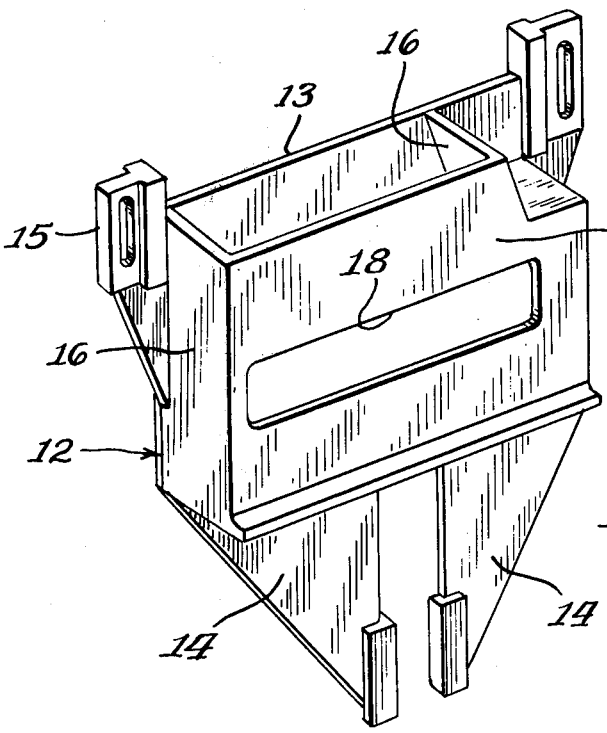
Fig. 2.

Fig. 5.
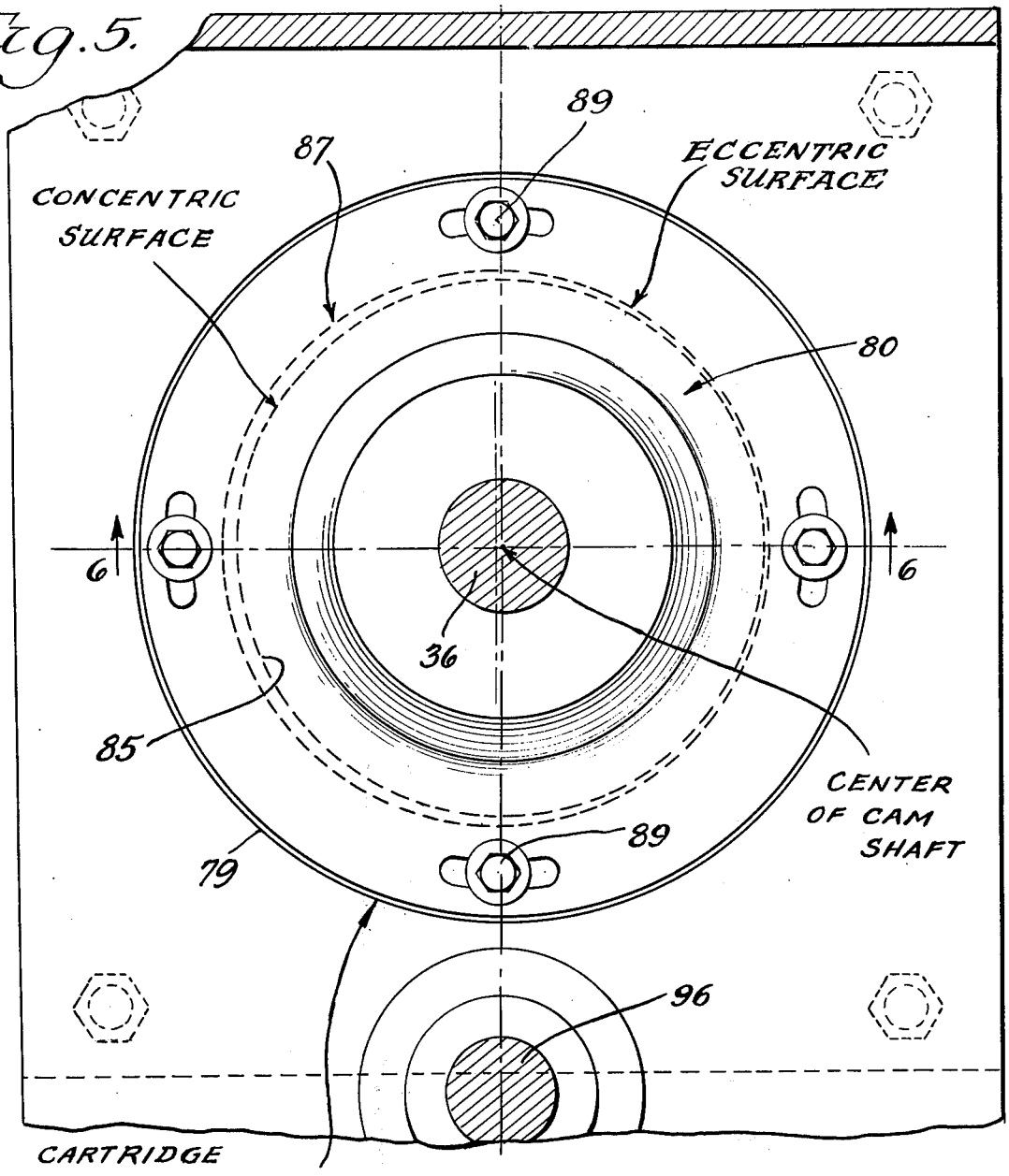
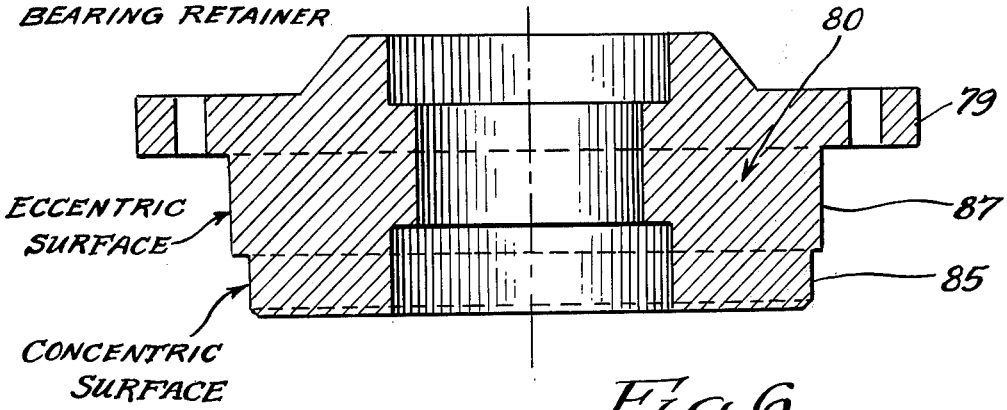
Fig. 6.

MODULAR CAM DRIVEN ROLL FEED

The invention relates to improved roll feeding mechanism for intermittently feeding strip material in desired lengths to a forming or punching press or similar machine and has reference more particularly to feeding mechanism which will incorporate cam and follower devices for intermittently rotating the feeding roll and which will also embody cam actuated means for periodically lifting the idler roll from the cam driven feed roll for releasing the material following a feeding operation.

It is conventional in the art of feeding strip material, such as tin plate, aluminum or other metals and also plastics, for the strip to be fed by a pair of rolls, namely a driven lower roll and an upper idler roll, to a press having a reciprocating die for punching, forming or cutting the strip material. The driven roll of the feeding couple is intermittently rotated by conjugate cams for advancing the material to the press and the other idler roll is resiliently forced in a contacting direction towards the driven roll to form the bite which results in an accurate advance or feeding of the strip material by eliminating slippage.

The invention has for its main objective to provide improved strip feeding mechanism of the character as described which will be modular as regards certain component parts including the cam and follower devices, the rollers of the feeding couple and the gears in the drive to the lower feed roll and also including the cam in the releasing means for the idler roll. Thus these elements can be removed and similar elements having different characteristics can be substituted therefor. Variations are thus made possible in the width of the material being fed, in the speed and duration of the feeding operation which determines the length of feed for a particular set of feed rolls and in the timing and duration of the releasing action of the lifter roll.

Another object of the invention resides in the provision of a gear housing for the incoming drive from the press and which will house an arrangement of bevel gears for rotating secondary shafts respectively, the secondary shafts extending horizontally in opposite directions with one of the shafts providing the drive to the lower driven feed roll and the other shaft having adjustable cam means thereon for producing the lifting and releasing action of the upper lifter roll.

Another and more specific object of the invention is to provide strip feeding mechanism as described wherein bevel gears drive secondary shafts respectively which extend in opposite directions with one secondary shaft having conjugate cams thereon and which is journalled by a main bearing cartridge unit embodying an eccentric arrangement whereby to permit initial installation of the shaft in a manner to eliminate all clearances in the bevel gears and in the drive from the conjugate cams to the cam followers.

Another object of the present invention is to provide a pair of spaced bearing units for journalling the secondary cam drive shaft in the cam housing, one bearing unit providing tapered bearings and being located on one side of the conjugate cams, the other unit journalling the shaft adjacent its terminal end, and wherein each unit embodies an eccentric arrangement which permits initial installation of the shaft in spaced walls of the housing and in a manner to eliminate all clearances and maintain metal to metal contact in the bevel gears and in the drive from the conjugate cams to their cam followers.

With these and other objects in view, the invention may consist of certain novel features of construction and operation as will be more fully described and particularly pointed out in the specification, drawings and claims appended thereto.

Figure 4:
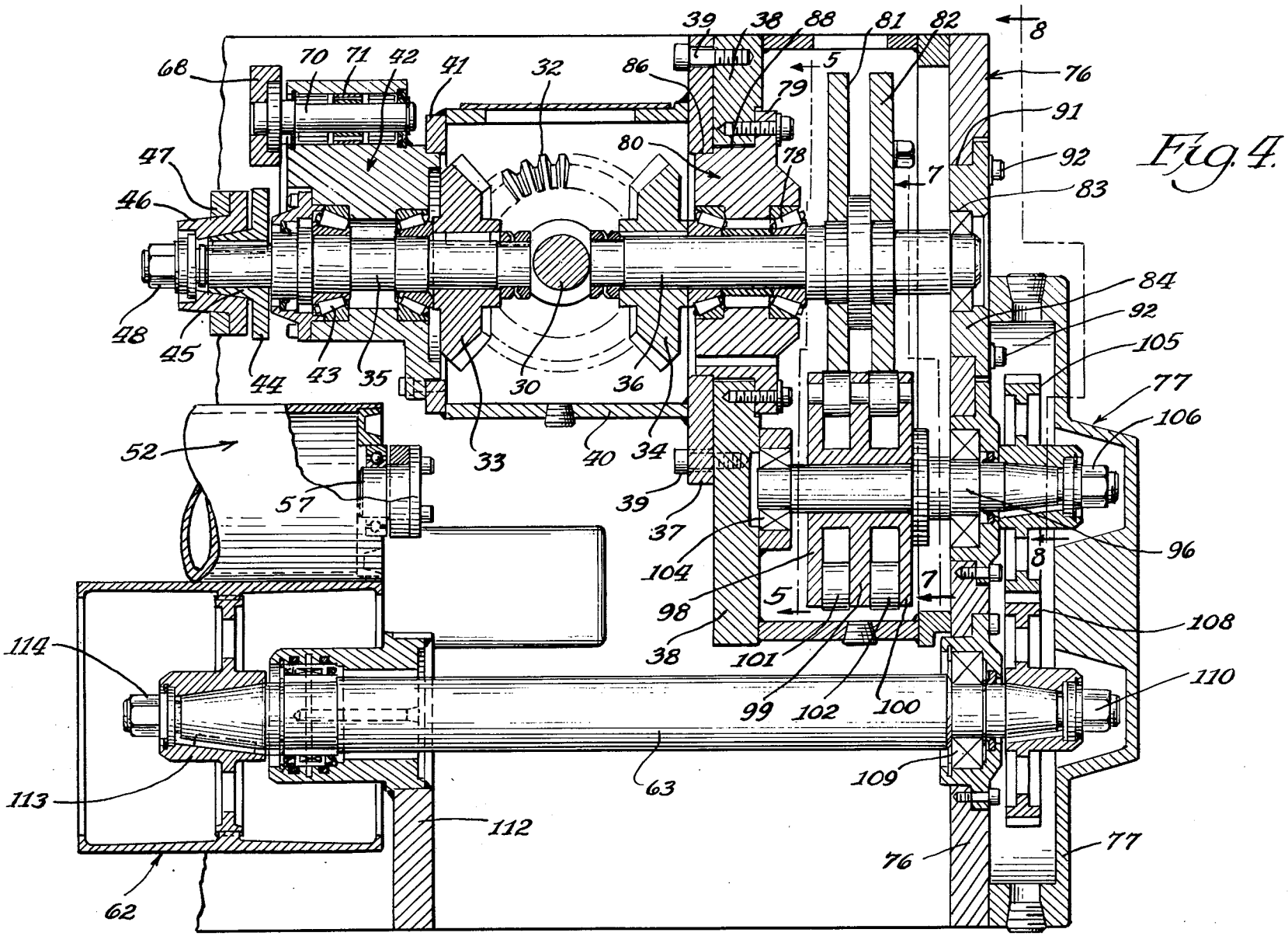
Figure 7:
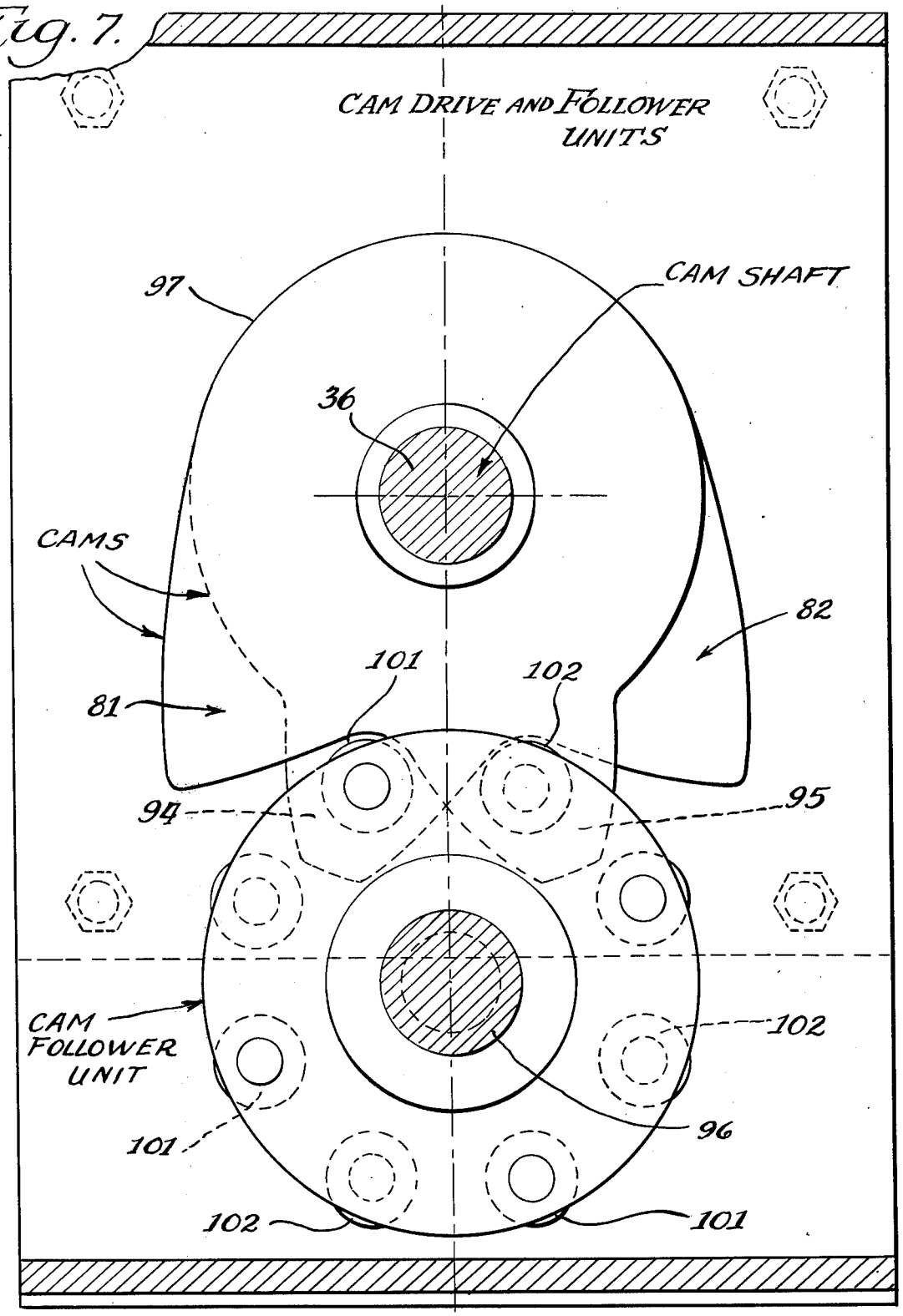
Figure 8:
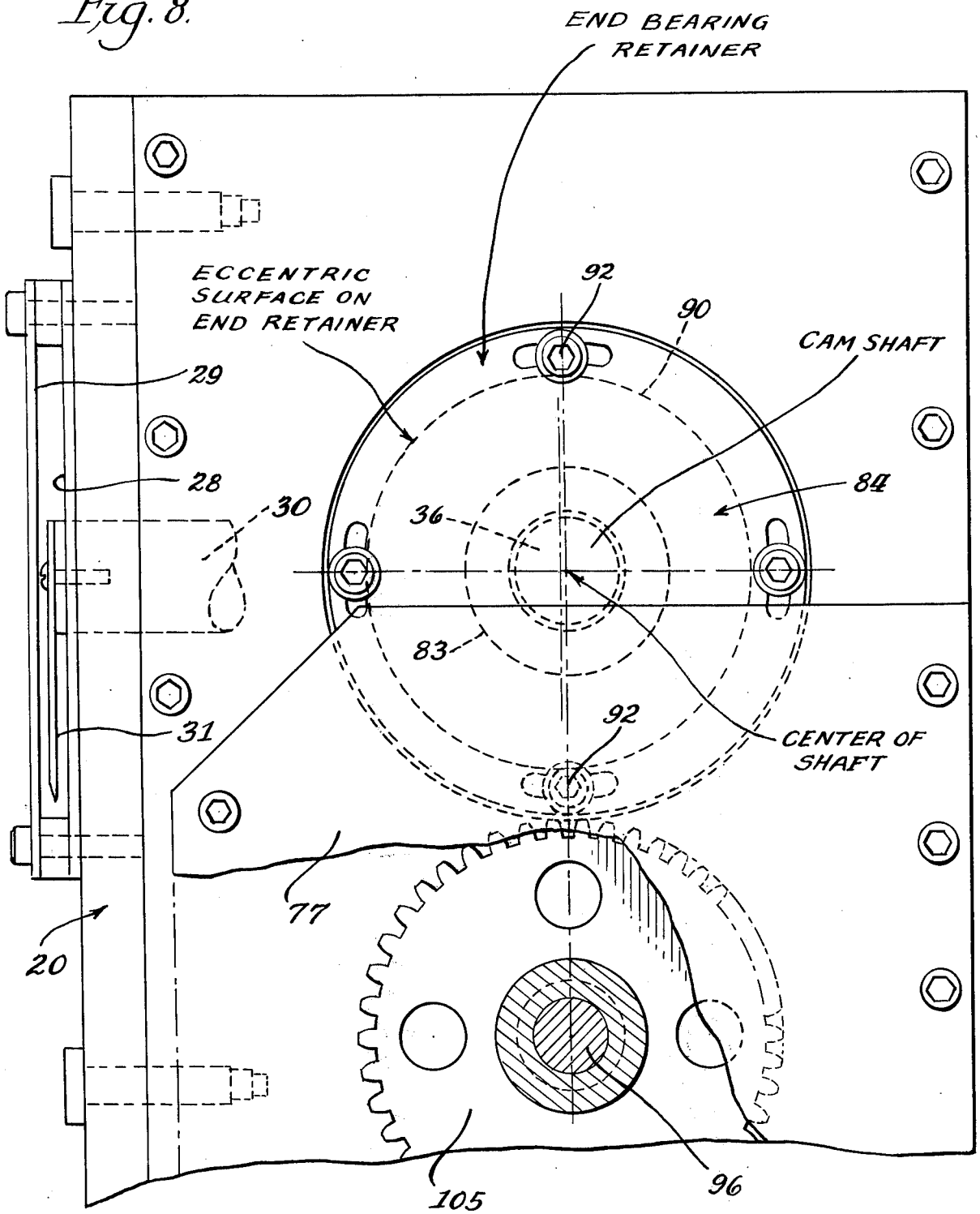

In the drawings which illustrate an embodiment of the apparatus and wherein like reference characters are used to designate like parts, FIG. 1 is a perspective view of the front entrance side of the strip feeding apparatus constructed in accordance with and embodying the improved features of the present invention, FIG. 2 is a front perspective view of the bracket for attaching the strip feeding apparatus of FIG. 1 to a press, FIG. 3 is a perspective view showing the rear or exit side of the present strip feeding apparatus and which illustrates the bevel gear arrangement in the drive to the secondary shafts, the conjugate cams and their cam follower units, the gear drive to the lower feed roll and the cam actuated idler roll lifter structure, FIG. 4 is a sectional view taken vertically through the strip feeding apparatus of FIG. 3 substantially on line 4—4 and which clearly shows the cam bearing cartridge retainer and the end bearing retainer for journalling the cam drive shaft in the cam housing, FIG. 5 is a vertical sectional view taken on line 5—5 of FIG. 4 but which shows the cam bearing cartridge retainer in front elevation, FIG. 6 is a horizontal sectional view taken through the cartridge retainer on line 6—6 of FIG. 5, FIG. 7 is a vertical sectional view on line 7—7 of FIG. 4 showing the conjugate cams and their cam follower devices, and FIG. 8 is a vertical elevational view taken on line 8—8 of FIG. 4 and showing the retainer for the end bearing which journals the cam shaft in the end wall of the cam housing.

FIG. 1 of the drawings shows the strip feeding apparatus of the invention, designated by numeral 10, applied to the entrance side of a press 11 by means of the bracket 12 best shown in FIG. 2. The rear wall 13 of the bracket includes the depending web portions 14 and the side extending slotted arms 15. The box shaped enclosure to which the strip feeding apparatus is directly secured, has side walls 16 and a front wall 17 and the enclosure is integral with the rear wall 13 of the bracket. The strip feeding apparatus 10 is suitably secured to the bracket and the bracket is in turn secured to the rear wall 11 of the press with the elongated openings 18 in both the front wall 20 of the apparatus and wall 17 of the bracket in proper horizontal alignment with the die of the press all as clearly understood in the art.

The entrance apron for the strip material, shown in FIG. 1 and designated by numeral 22, projects from the front wall 20 and the same includes the side arms 23 and the depending arcuate members 24 having the rollers 25 thereon. The strip material 26 may ride on the rollers as it is being fed through the openings 18 on its way to the press. The front wall 20 of the strip feeding apparatus also has the timing dial 28 fixed thereto and which is enclosed by the transparent guard 29. The terminal end of the main drive shaft 30, see FIGS. 3, 4 and 8, has the indicator 31 fixed thereto and which compliments the indica on the timing dial to show to the operator the action of the feed rolls in advancing the strip material intermittently.

Shaft 30 is preferably rotated by the press and in synchronism therewith and said shaft extends into a gear box as best shown in FIG. 4, where the bevel gear 32 on shaft 30 has meshing relation with the bevel gears 33 and 34 fixed to the secondary drive shafts 35 and 36 respectively. The gear box includes the side wall 37 which is secured in adjusted position to wall 38 of the cam housing by the screws 39, the details of which will be described as the description proceeds. The upper and lower walls of the gear box, namely 40, are suitably fixed to wall 37 and they in turn are fixed to side wall 41 located left of the gear 33. Wall 41 has the journalling hub 42 suitably secured thereto. It will be observed that the secondary shaft 35 is journalled for rotation in hub portion 42 by the bearing unit 43 having tapered bearings and that said shaft 35 extends beyond the hub portion to receive the cam retaining member 44. Said member is keyed on shaft 35 and has a forward extending conical nose 45 on which the cam member 46 is mounted. The adjustable cam 47 is in turn mounted on the cam member 46 and said cam member is secured to shaft 35 by the threaded nut 48. As best shown in FIG. 3, the adjustable cam 47 has a number of arcuate openings 50 which receive the headed screws 51 which have threaded relation in the cam member 46 and thus the actuating cam 47 is securely held in desired adjusted position on its drive shaft 35.

The cam 47 is the actuating cam for the upper idler lifter roll 52 journalled at 53 in the arms 54 of a lifter bracket 55. The bracket is in turn mounted for pivotal movement on the vertically slidable lifter roll adjusting plate 56. The bracket is capable of pivotal movement on a horizontal axis generally provided by members 57. The supporting members 57 for the bracket are fixedly secured to the adjusting plate 56 which is mounted for slidable movement on the rear side of front plate 20, being supported for such slidable movement by the gibs 58. The jack screw 60 and hand wheel 61 are available to the operator for moving the adjusting plate 56 up and down so that the lifter roll 52 can be precisely positioned with respect to the lower feed 62 fixed to and driven by the drive shaft 63. As well understood in the art, the lifter roll 52 is yieldingly forced in a direction towards the lower feed roll 62 so as to grip the strip material located between the rolls. For this purpose the bracket 55 has an upward vertically extending portion 64 which engages the air bag 65 in fixed supported position on the adjusting plate 56. The action of the air bag is to force the part 64 of the bracket outwardly and thus the lifter roll 52 is yieldingly forced downwardly towards lower roll 62.

The bite on the strip material between the feeding rolls is maintained during the feeding operation when the lower roll 62 is being rotated. However, when the rolls are stationary it is necessary to lift the upper idler roll 52 to release the grip on the strip material and this lifting action on the upper roll is effected by the actuating cam 47. The said cam has a high portion 66 adapted to contact the roller 67 during each revolution of the cam and thus the driving shaft 35. Roller 67 is mounted for rotation on a stud shaft carried by the pivot arm 68 which is pivotally supported by the shaft 70 journalled for pivotal movement by the bearing unit 71 having location in the hub portion 42, FIG. 4.

The terminal upper end of the pivot arm 68 carries the roller 72 which is in contact with the wear plate 74 on the upper part 64 of the bracket 555. The pressure of the air bag 65 forces the portion 64 and the wear plate 74 outwardly so that the wear plate is held in contact with roller 72. This in turn urges the pivot arm in a counter-clockwise direction and the roller 67 is likewise held in contact with the actuating cam 47. During each revolution of the main drive shaft 30, the feed rolls 52 and 62 will rotate for a major portion of the same and then remain at rest for a minor portion of each revolution or vice versa. Immediately following the rotating action of the feed rolls, the high portion 66 of the actuating cam 47 will be caused to contact roller 67 and rock the pivot arm clockwise against the pressure of the air bag and thus the bracket 55 is rocked to lift the upper roll 52. The roll will be held lifted for a time period as determined by the angular extent of the high portion 66.

FIG. 4 shows the two secondary drive shafts 35 and 36 as extending horizontally in opposed directions, shaft 35 left and shaft 36 right, and said shafts are driven by main shaft 30 in unison and at the same speed. Whereas shaft 35 drives the actuating cam 47 for the lifter roll 52, the shaft 36 drives the shaft 63 for rotating the feed roll 62. The cam housing within which the cam shaft 36 is journalled includes the wall 37, previously identified, and the rear wall 76 having the gear housing 77 on the rear surface thereof and which is sealed to wall 76 so as to contain oil without leaking. The cam shaft 36 is substantially jounalled about midway of its length by spaced bearing units 78 having tapered bearings and which are located in the cartridge bearing retainer 80 having a position between the bevel gear 34 and the conjugate cams 81 and 82, FIG. 7. The bearing retainer 80 has an annular flange 79, FIG. 6, provided with arcuate slots for receiving the screws 89. The terminal end of shaft 36 is journalled by a second bearing unit 83 carried by the bearing retainer 84.

The bearing retainer 80 embodies certain improvements of the present invention and which are best illustrated in FIGS. 5 and 6. The surface 85 of the bearing retainer is concentric with respect to shaft 36 which passes through the center of the retainer and this concentric surface is adapted to be located in the opening 86 formed in wall 37. For initial installation of the shaft 36, the screws 39 are loose and the wall 37 is thus loosely held by the screws on wall 38. This is desirable since the gear 34 can be meshed with gear 32 so as to eliminate all clearance between the teeth. However it is also desirable that the conjugate cams 81 and 82 have a metal to metal contact with their cam follower units also eliminating all clearances. In accomplishing these objectives, the cam shaft 36 may be positioned somewhat eccentrically of opening 86, possibly not more than five or fifteen thousandths of an inch, but when so eccentrically positioned for eliminating all clearances, then the wall 37 is firmly and fixedly secured to wall 38 by tightening the screws 39.

With wall 37 locked in place, the cartridge bearing retainer 80 is slightly rotated until the eccentric surface 87 interfits within opening 88 formed in wall 38. Accordingly the flange 79 has contact with the wall 38. As a result of this eccentric arrangement, the bearing retainer 80 journalls the shaft 36 without any stress or strain and in a manner having metal contact at onne end with its gear drive and at the other end with the cam follower units. The screws 89 can now be tightened to firmly and securely lock the bearing retainer in place on wall 38 of the cam housing. The cartridge bearing retainer 80 is accordingly characterized by a concentric surface 85 adapted to fit in an opening 86 in wall 37 and by an eccentric surface 87 adapted to fit in an opening 88 provided therefor in wall 38.

An eccentric arrangement is also built into the end retainer 84 since the surface 90 is eccentric as regards the shaft 36, as shown in FIG. 8. Here also the retainer is slightly rotated, after shaft 36 has been installed in the manner described, until the eccentric surface 90 interfits with opening 91 formed in end wall 76 of the cam housing. The screws 92 are then tightened and the end bearing retainer is thus locked in desired position on the wall 76.

The cams 81 and 82 on the cam driving shaft 36 as shown in FIG. 7, are fixed on the shaft in special angular relation as regards the lobes 94 of cam 81 with respect to lobes 95 of cam 82. This special angular arrangement in combination with the spherical portion 97 on each cam provides the dwell in the rotation of the cam follower shaft 96. The cam follower units on the shaft 96 consist of the integral plates 98, 99 and 100 and the rollers 101 and 102. Plates 98 and 99 are adjacent each other and they journal the four rollers 101. Plates 98 and 100 are also adjacent each other and they journal the rollers 102. The action of the lobes 94 and 95 in first engaging and then in releasing contact with the rollers respectively, will drive the cam follower shaft 96 in an intermittent manner although the cams and shaft 36 rotate continuously. When the spherical portion 97 of the cams is in contact with rollers then the shaft 96 remains stationary.

More particularly, the cams 81 and 82 will operate in a manner to rotate the cam follower shaft 96 for a feed cycle of approximately 210 degrees for each revolution of the shaft 36 and thus the cam follower shaft will remain at rest for the remainder of each revolution. It is possible due to the modular feature of the invention to remove the conjugate cams 81 and 82 and substitute cams having different configerations and thus the optional cams make possible a feed cycle from 90 degrees through 240 degrees.

The shaft 96 as best shown in FIG. 4 is journalled at respective ends in the walls 38 and 76 by bearings 104 and beyond the right hand bearing the shaft is tapered for receiving the hub portion of the driving gear 105, also shown in FIG. 8. The gear is held to the shaft by the threaded nut 106. The gear 105 is located within the gear housing 77 which is sealed so as to contain oil for lubricating the gear 105 and also the gear 108 having meshing relation therewith and which is mounted on the feed roll drive shaft 63. Said is journalled by bearing 109 in wall 76 and said end is tapered for receiving the hub portion of gear 108 which is held on the shaft by the threaded nut 110. At the left hand end of the feed roll drive shaft the same is suitably mounted for rotation in the intermediate wall 112 and the shaft also has a tapered end beyond the wall for receiving the centrally disposed hub portion 113 of the lower feed roll 62. The threaded nut 114 is employed for securing the roll on the talered end of said shaft 63.

The gears 105 and 108 have a one to one turn ratio since they have the same diameter. However, the modular feature of the invention provides for the release of the gears from their shaft, their removal and the substitution of different gears therefor having different turn ratios and thus the drive to the feed roll shaft 63 can be varied to suit desired feed lengths. In a manner similar to that as contemplated for the gears, it is also possible to remove the feed roll 62 from shaft 63 and substitute a feed roll of different diameter and different length for variable feeding action on strip material of greater or less width.

The apparatus of the invention employs a gear housing containing bevel gears and which drive a pair of secondary shafts 35 and 36 extending in opposite directions, one left and the other one right, FIG. 4. The left hand secondary shaft 35 is employed to rotate the actuating cams 47 and effect a lifting of the upper roll 52 to release the strip material from the bite of the rolls. The other secondary drive shaft 36 carries the conjugate cams 81 and 82 which effect an intermittent rotation of the cam follower shaft 96 by intermittent action on the rollers of the cam follower units. Through the gears 105 and 108 the lower feed roll shaft 63 is driven intermittently for feeding the strip material located between the rolls. A variety of feeding actions can be obtained due to the modular feature which has been incorporated in the present apparatus. The conjugate cams can be changed to vary the characteristics of the feeding cycle which takes place during each revolution of the main drive shaft 30. Also the gears 105 and 108 can be changed in addition to the lower feed roll 62. The rotating cycle for the feed rolls can thus be varied as can also the length and diameter of the feed rolls.

What is claimed is:

1. In cam driving apparatus of the character described, the combination with a housing including two apaced walls, of a driving shaft within said housing, means for journalling the said shaft for rotation including a bearing cartridge retainer in one wall of the housing, said bearing cartridge retainer having a center opening through which the shaft extends and also having a machined peripheral surface the center of which is eccentric to the center of the shaft, and the said one wall of the housing having an opening therein for receiving the cartridge retainer in a manner whereby the peripheral surface thereof has close contacting relation with the inside surface of said opening.

2. Cam driving apparatus of the character as defined by claim 1, additionally including an annular flange on the bearing cartridge retainer extending radially outward on one side of the machined peripheral surface, said outwardly extending flange having a plurality of arcuate slots therein spaced an equal distance angularly around the flange, and a securing screw passing through each arcuate slot for securing the bearing cartridge retainer in position on the said one wall of the housing.

3. In roll feeding apparatus, the combination with a pair of feeding rolls, of a driving shaft for driving one of said rolls, a housing having two spaced side walls between which the shaft is located and journalled thereby, a bearing cartridge retainer journalling the shaft in one of said walls, said bearing cartridge retainer having a center opening through which the shaft extends and also having two machined peripheral surfaces thereon in side by side relation, one surface adjacent one side of the cartridge retainer being concentric with the center of the shaft and the second surface inwardly of said one surface being eccentric as regards the center of the shaft.

4. Roll feeding apparatus as defined by claim 3, wherein the said one wall of the housing has an opening therein adapted to receive the bearing retainer with the eccentric peripheral surface thereof in close contacting relation with the inside surface of said opening, and additionally including an annular flange on the bearing retainer extending radially outward on the side adjacent the peripheral eccentric surface, said flange having a plurality of arcurate openings therein spaced an equal distance angularly around the flange, and a securing screw passing through each arcuate slot for securing the bearing retainer in position on the said one wall of the housing.

5. Roll feeding apparatus as defined by claim 4, additionally including a second wall having a secured relation with the said one wall of the housing and located on the side thereof opposite the flange, said second wall having an opening therein in substantial horizontal alignment with the opening in the said one wall, and the bearing cartridge retainer being mounted in both said walls by having its concentric peripheral surface located within said in close contacting relation with the inside surface of the opening in the second wall.

6. In roll feeding apparatus, the combination with a pair of feeding rolls, of a driving shaft for driving one of said rolls, a housing having two spaced side walls between which the shaft is located and journalled thereby, a bearing cartridge retainer for journalling the shaft in one of said walls, a pair of cams on the shaft adjacent the bearing cartridge retainer, the said retainer having a machined peripheral surface the center of which is eccentric to the center of the bearing retainer and also the shaft, the said one wall of the housing having an opening therein for receiving the bearing retainer with the eccentric peripheral surface thereof in close contacting relation with the inside surface of the opening, and a second bearing retainer for journalling the terminal end of the shaft in the other wall of the housing, said second retainer also having a machined peripheral surface which is eccentric to the center of the retainer and the shaft, and said other wall of the housing having an opening therein for receiving the second bearing retainer with the eccentric surface thereof in close contacting relation with the inside surface of the opening.

7. In cam driving apparatus of the character described, the combination with a housing including two spaced walls, of a driving shaft within said housing, a bearing cartridge retainer journalling the driving shaft in one of said walls, a second bearing retainer journalling the terminal end of the shaft in the other wall, a pair of conjugate cams on the shaft located between the bearings retainers, a cam follower shaft mounted for rotation by said spaced walls, cam follower units on the cam follower shaft and positioned for co-action with the conjugate cams, whereby the cam follower shaft is driven intermittently as determined by the contour of the conjugate cams, a gear mounted on and releasably fixed to the cam follower shaft, a second driving shaft journalled for rotation and located in proximity to the cam follower shaft, and a second gear mounted on and releasably fixed to the second driving shaft, the second gear having meshing relation with the gear on the cam follower shaft.

8. Cam driving apparatus of the character as defined by claim 7, wherein both the cam follower shaft and the second driving shaft pass through and extend beyond the said other wall of the housing, and wherein the extending end of each shaft is tapered to facilitate the mounting of the respective gears on said shafts.

* * * * *